United States Patent [19]

Bosse et al.

[11] Patent Number: 4,462,431

[45] Date of Patent: Jul. 31, 1984

[54] METHOD AND APPARATUS FOR FORMING Z-SHAPED FOLDS IN A TUBULAR FILM AND FOR INSERTING THE LATTER INTO A WOVEN TUBING

[75] Inventors: Frank Bosse, Tecklenburg; Karl-Heinz Lage, Lengerich, both of Fed. Rep. of Germany

[73] Assignee: Wind Möller & Hölscher, Lengerich, Fed. Rep. of Germany

[21] Appl. No.: 361,339

[22] Filed: Mar. 24, 1982

[30] Foreign Application Priority Data

Mar. 25, 1981 [DE] Fed. Rep. of Germany ..... 3111829

[51] Int. Cl.[3] ..... D03D 37/00; D03D 49/00; D03J 1/00

[52] U.S. Cl. ..... 139/13 R; 139/291 R; 66/147; 156/227

[58] Field of Search ..... 139/13 R, 291 R, 291 C; 66/147; 156/227, 204, 293

[56] References Cited

U.S. PATENT DOCUMENTS

| | | | |
|---|---|---|---|
| 2,913,799 | 11/1959 | Rabeux et al. | 139/13 R |
| 4,065,339 | 12/1977 | Lippert et al. | 156/227 X |
| 4,373,979 | 2/1983 | Planeta | 156/227 X |

FOREIGN PATENT DOCUMENTS

| | | | |
|---|---|---|---|
| 632547 | 7/1936 | Fed. Rep. of Germany | 139/13 R |
| 869627 | 3/1953 | Fed. Rep. of Germany | 139/13 R |
| 1281234 | 7/1972 | United Kingdom | 66/147 |

*Primary Examiner*—James Kee Chi

*Attorney, Agent, or Firm*—Fleit, Jacobson, Cohn & Price

[57] ABSTRACT

Z-shaped folds are formed in a tubular film and the latter is inserted into a woven tubing as the latter is woven and collapsed in a circular loom. The tubular film is squeezed between pairs of pinch rollers and is then inflated to form a bubble, which is supported by annular surfaces at the weaving ring and at a distance from the latter so that the bubble bulges between the annular surfaces so as to form an annular bead. A Z-shaped annular fold is formed in that tubular film in that edge portion of said annular bead which is remote from the weaving ring is pushed into the latter. For the fixation of the Z-shaped folds e.g., at the portions which will subsequently form the rims at the open ends of the bags to be made, it may be desirable to apply adhesive to the tubular film above the Z-shaped folds and to force said adhesive-coated portions against the inside surface of the surrounding woven tubing.

7 Claims, 2 Drawing Figures

METHOD AND APPARATUS FOR FORMING Z-SHAPED FOLDS IN A TUBULAR FILM AND FOR INSERTING THE LATTER INTO A WOVEN TUBING

Apparatus for carrying out the method according to the invention is characterized in that a pair of pinch rollers for feeding the tubular film are disposed above the weaving ring, a cylindrical ring for confining the inflated tubular film is disposed above the weaving ring between the latter and the pair of pinch rollers and is concentric to the weaving ring and has an outside diameter which is smaller than the inside diameter of the weaving ring, and driving and guiding means are associated with the cylindrical ring for an axial movement of the latter between an upper position above the weaving ring and a lower position, in which said cylindrical ring extends into the weaving ring.

Additional desirable improvements provided by the invention will be described in the sub-claims.

If the cylindrical ring is properly controlled, the apparatus according to the invention can be used to form Z-shaped folds in the tubular film at intervals which correspond to the lengths which will subsequently be severed from the tubular film in the manufacture of sacks and the tubular film may be secured to the woven tubing by means of adhesive coatings applied to the tubular film above each Z-shaped fold. For the formation of the Z-shaped folds, the cylindrical ring is lowered into the weaving ring when the folds have been turned in to tension the bubble so that the latter forms an annular bead between the cylindrical ring and the weaving ring. As a result, the tubular film is caused to adhere to the weaving ring in that the cylindrical ring being lowered into the weaving ring draws in the bead with formation of a Z-shaped fold and virtually peels the bulge from the inside surface of the weaving ring until the Z-shaped fold has been formed in the desired length. Through slots formed in the cylindrical ring, adhesive is applied to the tubular film so as to form adhesive coatings on the tubular film above the Z-shaped fold and under the superatmospheric pressure of the air contained in the bubble said adhesive coatings are forced against the inside surface of the woven tubing. The hinged plates are then turned out so that the bubble is relaced and the cylindrical ring can be extracted from the weaving ring without pulling open the Z-shaped fold which has been formed.

The nozzles for discharging the adhesive are suitably mounted on a carrier for the cylindrical ring and can be moved along the slots.

Figure 1:
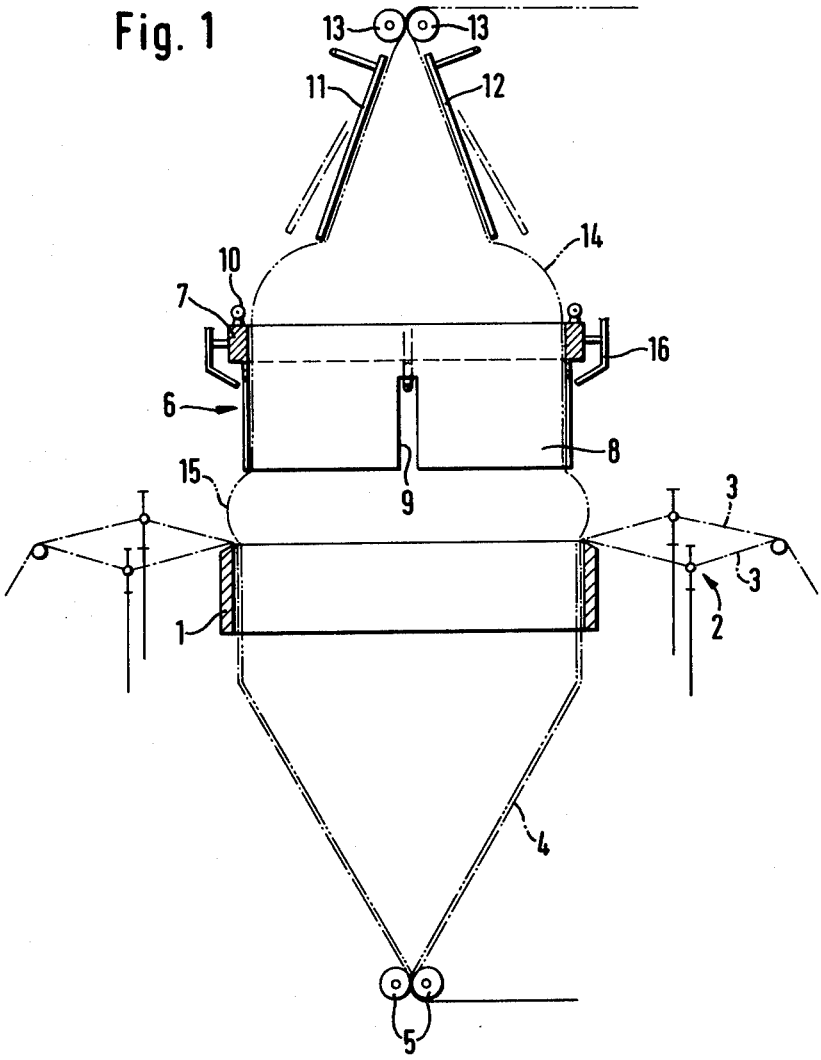

An illustrative embodiment of the invention will now be explained more in detail reference to the drawing, in which FIG. 1 is a diagrammatic longitudinal sectional view showing the apparatus for forming Z-shaped folds in a tubular film and for inserting the latter. The folding ring is shown in its upper position and the bubble in an inflated state.

Figure 2:
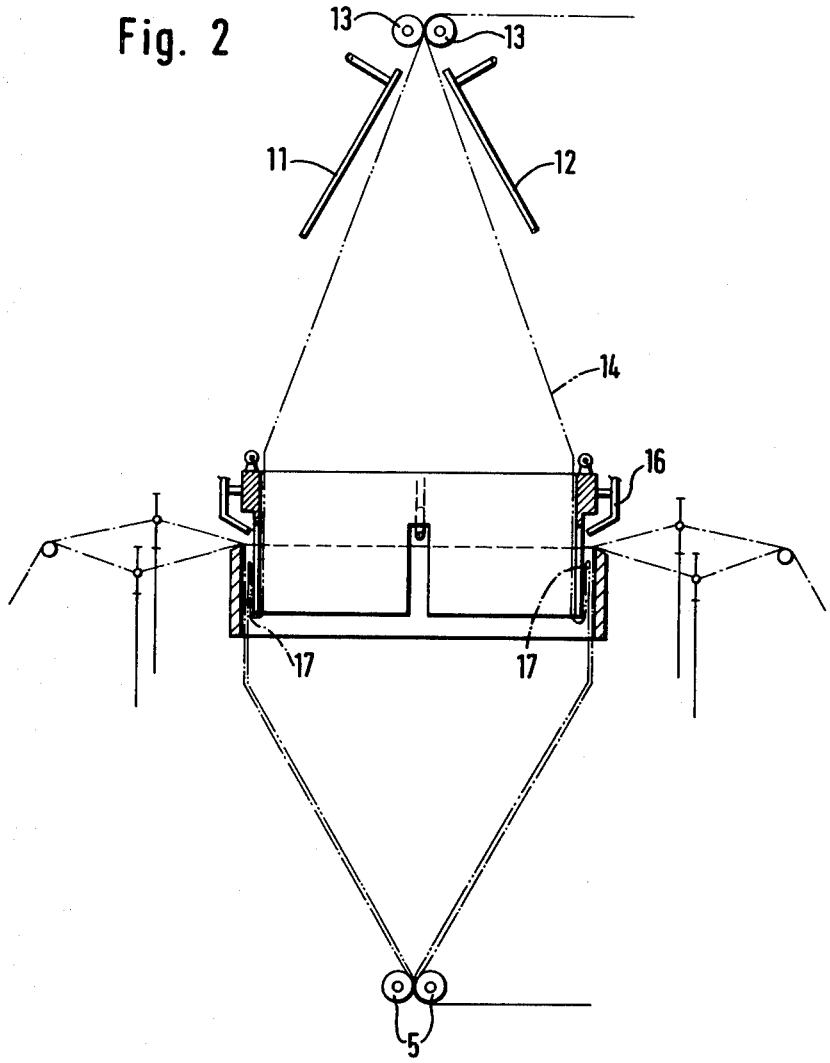

FIG. 2 shows the apparatus of FIG. 1 when the folding ring has been lowered into the weaving ring and the bubble has been relaxed.

Only the weaving ring 1 and the shedding means 2 of a circular loom are shown on the drawing. The loom is conventional and for that reason is not shown in more detail. The loom serves to weave plastic sheeting tapes 3 into a tubing 4. A pair of pinch rollers 5 are provided to pull down and collapse the tubing 4. A folding cylinder 6 is disposed above the weaving ring 1 and consists of an annular bracket 7 and a cylinder 8, which consists of relatively thin material and is secured to the bracket 7. The cylinder 8 has four indentations 9 and its outside diameter is smaller than the inside diameter of the weaving ring 1 so that the entire folding cylinder 6 can be lowered to insert the cylinder 8 into the weaving ring 1 to a larger or smaller depth as may be required. A guide ring 10 is secured to the annular bracket 7 on that side thereof which is opposite to the cylinder 8 and comprises a multiplicity of Teflon rollers aligned on an axis. Two plates 11 and 12 are mounted over that guide ring 10 and are pivotally movable toward and away from each other. The tubular film 14 is fed by the pinch rollers 13 and passes between the plates 11 and 12. It is apparent from the drawings that adhesive-discharge nozzles 16 are provided adjacent to the indentations 9 and can be moved up and down in unison with the folding cylinder and can also be moved relative to the folding cylinder.

The mode of operation of the apparatus will now be described.

When the plates 11 and 12 have been swung down, the tubular film 14 between the pinch rollers 13 and the take-off rollers 5 is inflated under low pressure applied through an injecting needle or the like to form a bubble. During the weaving of the tubing 4, the tubular film 14 is inserted into the outer tubing 4 to form a liner therein. The pinch rollers 13 and the take-off rollers 5 are driven to rotate at the same peripheral velocity. When the hinged plates 11 and 12 are now moved toward each other, they will compress the adjacent portion of the bubble and the air which is thus displaced will force the tubular film 14 outwardly between the folding cylinder 6 and the weaving ring 1 and will cause said portion of the tubular film to form a bead 15. The tubular film 14 can be forced out also through the indentations 9 in dependence on the width thereof.

When the bulge 15 has been formed, the folding cylinder is lowered at a velocity which exceeds the take-off velocity that is determined by the take-off rollers 5. As a result, the folding cylinder enters the weaving ring 1 to such a depth that a Z-shaped fold 17 of desired depth is formed.

During that phase the pinch rollers 13 are rotated at a higher speed, which corresponds to the velocity of the folding cylinder. At this time the speed at which the folding cylinder 6 is lowered and the speed of the pinch rollers 13 is matched to the speed of the pair of rollers 5, which are driven to rotate at a constant peripheral velocity. When the speeds have thus been matched, adhesive is discharged by the nozzles 16, which are connected to the annular bracket 7, e.g., by hydraulic piston-cylinder units, which are not shown. In response to the operation of said piston-cylinder units, the nozzles 16 are raised toward the bracket 7 so that four strip-shaped adhesive coatings are applied to the tubular film 14 in areas which are regularly spaced around its periphery. Thereafter the discharge of adhesive from the nozzles is terminated and the folding cylinder 6 continues to be lowered into the weaving ring to such a depth that the tubular film 14 is joined by the adhesive strips to the woven tubing 4. Thereafter the folding cylinder 6 and the nozzles 16 secured to the bracket 7 are returned to their initial position shown in FIG. 1. The plates 11 and 12 have previously been moved apart so that the Z-shaped fold cannot be pulled open as the folding cylinder 6 is raised.

Sacks, for instance for holding 50 kg, are then made from the lined woven tubing thus obtained. In the resulting sacks, the liner is connected to the outer sack adjacent to the open end of the sack by four adhesive strips so that when the sack is opened in order to be filled, the liner will always be opened too. As the sack is filled, the Z-shaped fold formed in the liner closely below the adhesive strips is gradually pulled open by the material flowing into the liner so that the latter can bear on the outer sack in an unstressed condition and need not perform any carrying function.

What is claimed is:

1. A method of forming Z-shaped folds in a tubular film and of inserting said tubular film into a woven tubing as the latter is woven and collapsed in a circular loom, said method comprising:

squeezing a tubular film between pairs of pinch rollers;

inflating the tubular film to form a bubble supported by annular surfaces at a weaving ring and at a distance from the latter so that the bubble bulges between the annular surfaces so as to form an annular bead; and forming a Z-shaped annular fold in the tubular film by pushing into a weaving ring an edge portion of said annular bead which is remote from the weaving ring.

2. A method according to claim 1, including comprising the bubble to form or widen the annular bead before the latter is pushed into the weaving ring.

3. A method according to claim 1 or 2, including providing adhesive coatings on the tubular film above said Z-shaped folds, and forcing the coatings against the inside surface of the surrounding woven tubing.

4. Apparatus for forming Z-shaped folds in a tubular film and for inserting the tubular film into a woven tubing as the latter is woven and collapsed in a circular loom, said apparatus comprising:

a weaving ring;

a pair of rollers disposed below the weaving ring to collapse and take off woven tubing;

a pair of pinch rollers for feeding tubular film disposed above the weaving ring;

a cylindrical ring for confining inflated tubular film disposed between the weaving ring and the pair of pinch rollers, the cylindrical ring being concentric to the weaving ring and having an outside diameter smaller than the inside diameter of the weaving ring; and driving and guiding means for axially moving the cylindrical ring between an upper position above the weaving ring and a lower position, in which said cylindrical ring extends into the weaving ring.

5. Apparatus according to claim 4, wherein the cylindrical ring has at least two axial slots which are open at the lowwer end of the cylindrical ring, and nozzles adjacent to and directed toward the upper portions of said slots for discharging adhesive.

6. Apparatus according to claim 5, wherein the nozzles are movable along said slots.

7. Apparatus according to any of claims 4 to 6 including plates movable toward each other and disposed below the pair of pinch rollers on opposite sides of a tubular film which has been inflated to a slack condition, said plates movable inwardly against a tubular film bubble so that the bubble bulges between the weaving ring and the cylindrical ring when the latter is in its upper position.

* * * * *